US006371057B1

(12) United States Patent
Henderson

(10) Patent No.: US 6,371,057 B1
(45) Date of Patent: Apr. 16, 2002

(54) ADJUSTABLE MOUNT FOR A GAS CONTROL VALVE OF A WATER HEATER

(75) Inventor: Alan D. Henderson, Lane Cove (AU)

(73) Assignee: SRP 68/Pty. Ltd. (AU)

( * ) Notice: Subject to any disclaimer, the term of this patent is extended or adjusted under 35 U.S.C. 154(b) by 0 days.

(21) Appl. No.: 09/745,087

(22) Filed: Dec. 21, 2000

(51) Int. Cl.[7] ..... F22B 5/04

(52) U.S. Cl. ..... 122/14.2; 122/17.1; 122/19.2; 137/487.5; 392/455

(58) Field of Search ..... 122/10, 14.2, 14.21, 122/17.1, 14.31, 19.2, 18.31; 137/87.01, 487.5; 392/453, 455

(56) References Cited

U.S. PATENT DOCUMENTS 4,001,547 A * 1/1977 Boggs et al. ..... 219/322
5,020,512 A * 6/1991 Vago et al. ..... 122/17.1
5,261,438 A * 11/1993 Katchka ..... 126/361
5,620,016 A * 4/1997 Katchka ..... 126/361
6,230,665 B1 * 5/2001 Reynolds et al. ..... 122/19.2
6,302,062 B2 * 10/2001 Overbey, Jr. et al. .... 122/13.01

* cited by examiner

*Primary Examiner*—Gregory A. Wilson
(74) *Attorney, Agent, or Firm*—Schnader Harrison Segal & Lewis LLP

(57) ABSTRACT

A fitting for connecting a gas control valve to a water storage tank of a gas water heater comprising a base member having an elongated opening sized and shaped to receive a mating locator attached to the tank, which permits connection of the valve and tank together and allows relative movement while the connection is maintained.

22 Claims, 10 Drawing Sheets

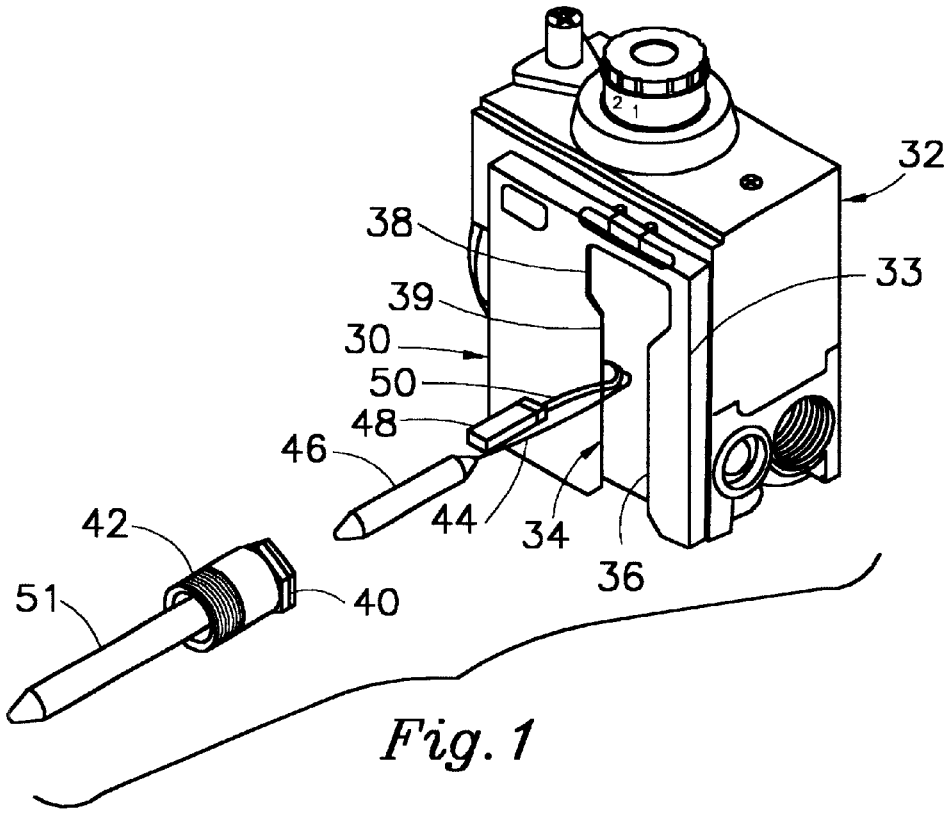
Fig. 1
Fig. 2
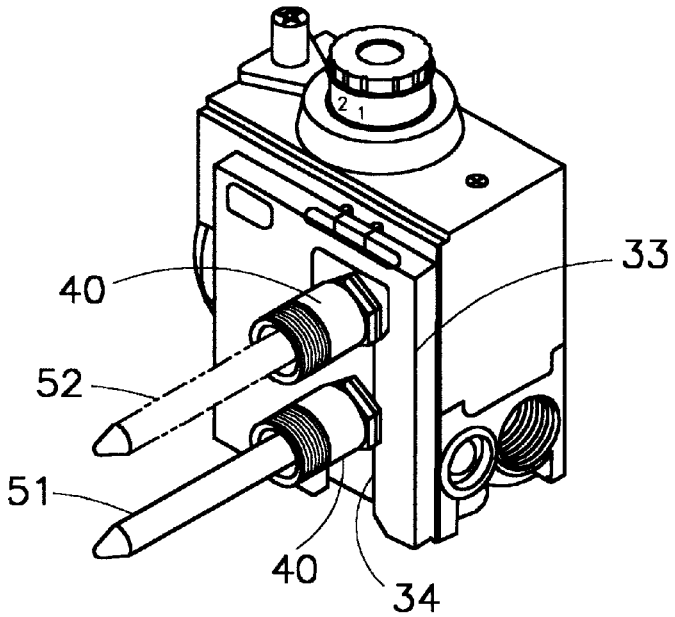

ADJUSTABLE MOUNT FOR A GAS CONTROL VALVE OF A WATER HEATER

FIELD OF THE INVENTION

This invention relates to gas-fueled water heaters, with particular application to high volume produced water heaters of the so-called "sealed" combustion chamber type. It relates also to methods of their assembly.

BACKGROUND

The cost of high volume production of gas-fueled water heaters of the type with sealed combustion chambers has proven higher than that of conventional ones because of variations in component part dimensions. Although complying with industry norms, when applied to the sealed combustion chamber type, these variations add together to become more dimensionally important and so render high speed assembly more difficult. The assembly of a water heater involves a number of different components including a tank, a combustion chamber, a burner, a gas control valve, a reflecting pan under the burner to protect the floor underneath the water heater from burner heat and numerous other elements, including insulation, being brought together on an assembly line. How well the parts combine determines to some extent the manufacturing cost. The desire to assemble quickly at minimum cost can not be allowed however to prejudice user safety by risking, when a water heater is installed, flammable gas fuel escape from ill-fitting joints.

Over recent years, numerous solutions have been proposed in relation to gas-fueled water heaters in general to address safety and efficiency increases and atmospheric pollution reductions. Some solutions involve "sealed" combustion chambers, for various reasons, discussed below. The great majority of conventional water heaters meeting the same market demands have traditionally had open combustion chambers. An open combustion chamber allows, for example, lighting of the pilot burner through an access hole using a match or taper. Also, the burners utilize secondary air in the combustion process, where that air can enter freely through an inspection or burner service opening.

A sealed combustion chamber type in this context is sealed in the sense that air for combustion is permitted to enter the combustion chamber through designated openings. These include an opening remotely above the heater or outside of the room in which the heater is installed. They may also include a type protected from flame flash-through from inside the combustion chamber. Or, they may only admit air through the burner after it is pre-mixed with the gas fuel. Any so-called sealed combustion chamber in a storage water heater is of course open where the products of combustion escape to atmosphere. Most commonly, this is at the outlet of a single tube passing through the storage tank.

Conventional gas fired water heaters normally include a tank, which contains pressurized water, a water inlet from a mains pressurized supply and a water outlet. Heating of the tank involves a combustion chamber positioned below or within the tank, a gas control valve positioned adjacent an external vertical wall of the tank and a burner positioned within the combustion chamber. As much as possible of the assemblage of parts is thermally insulated.

Conventionally, the gas control valve senses the temperature of water within the tank. When the water temperature drops below a certain minimum, gas is allowed to flow through the gas valve to the burner within the combustion chamber where it is ignited by a pilot burner, heating the combustion chamber and the body of water above (or, less commonly, around) the combustion chamber. The products of combustion are vented through a tube connected to the combustion chamber and passing through the water tank. This conventional construction has been common for many decades. Numerous variations upon this construction have been created in attempts to increase efficiency and otherwise improve operating characteristics.

The desire for sealed combustion chambers includes the following:

(a) The safe operation of gas-fueled water heaters, despite unintended presence of dangerous flammable fumes around the air inlet, has become a particular goal of the water heater industry. The problem that I sought to solve arose in such a context but has broader application in water heaters.

(b) Concern for the environment has made the elimination of potentially polluting substances in the products of combustion more important. Whilst any single gas fired water heater is a very low polluter when compared to many other fuel consuming products, because water heaters are so numerous, any reduction may produce a worthwhile total benefit. Government regulation and stated consumer preference has, therefore, encouraged manufacturers to further reduce the contribution of pollutants emanating from water heaters. Many proposed solutions to reducing such pollutants from water heaters have involved approaches using sealed combustion chambers.

In addition to all of the above very important design improvements proposed, cost is a very important factor in producing water heaters. Water heaters are purchased by builders and home-owners in a very competitive environment. The products are mass-produced, typically on assembly lines running at a rate of up to 250 per hour. Some 5 million gas-fueled water heaters are believed sold throughout the United States of America marketplace each year and national companies compete very aggressively for sales. Water heaters must therefore be very economically manufactured or they will not sell and consumers will not gain the benefits of design improvements.

SUMMARY OF THE INVENTION

The invention provides a fitting connecting a gas control valve to a wall of a water storage tank of a gas water heater, the fitting comprising a substantially vertically extending elongated opening to receive a mating locator attached to the wall, to connect the valve and tank together and allow relative substantially vertical movement whilst connected.

The fitting may include a separate bracket attached to the valve having the elongated opening or may be in the wall of the valve itself. The elongated opening may take several forms, including a parallel-sided slot or an irregular hexagon having a longitudinal axis of symmetry extending substantially vertically or a rectangle having its longer sides extending vertically.

The mating locator may be integral with a pocket extending substantially horizontally inwardly into the tank, the pocket being of a form to enclose a temperature sensor forming part of the valve. Alternatively, the pocket may extend along an exterior surface of the tank wall.

The fitting provides dimensional assembly tolerance in the manufacture of water heaters on high volume production lines and usefully permits relative substantially vertical movement in the range of at least about $1/8^{th}$ to about 2 inches (about 3 mm to about 50 mm).

The fitting further includes a locking device connectable to one of the fitting and the valve, to prevent relative substantially vertical movement of the valve when the locking device is connected to the one of the fitting and the valve and to a part of the water heater.

On completion of assembly, the fitting normally relies for its required firm holding of the valve on the rigid pipe connecting the outlet port of the valve with a burner enclosed in a predetermined fixed position in a sealed combustion chamber fixed rigidly to the base of the tank of the water heater.

The rigidity of the fitting can be augmented by a substantially right-angled tab joining the fitting or the valve body itself to a nearby surface of a jacket of the water heater.

The invention also relates to a method of assembling to a water heater tank, to produce a water heater, a sub-assembly comprising a gas control valve, burner and combustion chamber, the method including the steps of:

a) providing in the water heater tank a pocket to receive a temperature sensor;

b) producing the sub-assembly of the gas control valve, the burner and the combustion chamber, the gas control valve being connected to the burner via at least one substantially rigid conduit;

c) providing an adjustable mount for mounting the gas control valve to the water heater tank;

d) positioning the temperature sensor into the pocket;e)

e) positioning the combustion chamber near/adjacent to a base of the water heater tank;

f) mounting the control valve to the water heater via the adjustable mount; and g) causing relative movement between the combustion chamber and the water heater tank and the control valve relative to the adjustable mount to reposition the gas control valve on the mount and have the combustion chamber engage the tank.

The invention also relates to a method of assembling to a water heater tank, to produce a water heater, a first sub-assembly comprising a gas control valve and a gas burner, the method including the steps of:

a) providing a water heater tank and an open combustion chamber adapted to be sealed by a manifold plate and joining the tank and chamber together;

b) providing in the water heater tank a pocket to receive a temperature sensor;

c) providing the sub-assembly of the gas control valve and the burner, the gas control valve being connected to the burner via at least one substantially rigid conduit;

d) providing an adjustable mount for mounting the gas control valve to the water heater tank;

e) providing a mating adaptor on the outwardly protruding end of the pocket;

f) aligning the base of the tank with a combustion chamber having a base pan and legs;

g) assembling the combustion chamber to the tank by axial movement relative to one another, substantially circumferentially aligning the combustion chamber entry hole with the mating adaptor;

h) providing a second sub-assembly comprising a manifold plate, through which passes a plurality of tubes and a plurality of shielded wires respectively connecting, a main burner, a pilot burner, a thermocouple and a pilot light igniter to the gas control valve;

i) providing a jacket and insulation layer between the tank and the jacket, while substantially aligning an entry hole in the jacket and the entry hole in the combustion chamber; and j) inserting the first sub-assembly into the insulated and jacketed tank and combustion chamber, while substantially simultaneously inserting the temperature sensor bulb and energy cut-out into the pocket and attaching the gas valve to the mating adaptor at the protruding end of the pocket.

The invention further relates to a gas-fueled water heater comprising:

a storage tank;

water inlet and outlet connections to the tank;

a combustion chamber connected to one end of the tank;

a main burner and pilot burner adapted to be located in pre-determined positions in the combustion chamber;

a gas supply pipe;

a gas control valve having an inlet port to receive a supply of full gas from the gas supply pipe;

a pipe adapted to connect an outlet port of the valve to the main burner, the pipe having a bend between its opposite ends;

a temperature sensor connected to the gas control valve by a flexible tube, the sensor being adapted to co-operate with the gas valve to control water temperature in the tank at a location of a pocket adapted to house the temperature sensor, the pocket being attached to a wall of the tank;

an insulation layer surrounding the tank and a protective jacket surrounding the insulation layer;

a mounting adapted to connect the gas control valve to the water heater in an adjustable position relative to the pocket;

the mounting including an elongated opening to receive a mating locator with the gas control valve, so as to releasably connect the valve and mounting together and allow relative movement whilst connected.

BRIEF DESCRIPTION OF THE DRAWINGS

Embodiments of the present invention will now be described by way of example only, with reference to the accompanying drawings in which:

FIG. 1 is a perspective view of a gas control valve adjustable mount, attached to a gas valve for assembly to a gas fueled water heater, according to a first embodiment of the invention.

FIG. 2 is a view of the mount of FIG. 1 showing schematically how it is adjusted into its final position.

DETAILED DESCRIPTION OF THE INVENTION

Figure 3:
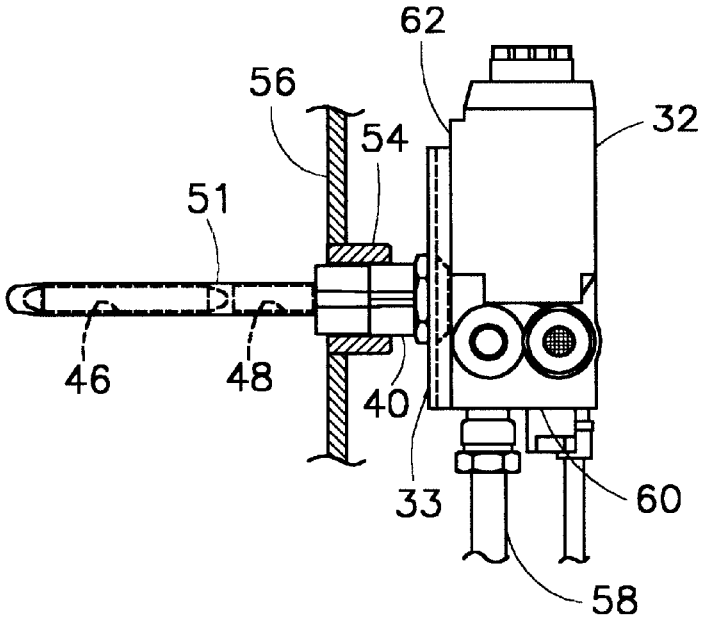
FIG. 3 is an elevational view of the mount and valve of FIG. 1 mounted to a wall of a tank of a water heater, which is taken in section.

The following description is intended to refer to specific embodiments of the invention illustrated in the drawings and is not intended to define or limit the invention, other than in the appended claims. Also, the drawings are not to scale and various dimensions and proportions are contemplated.

Turning now to the drawings in general and FIGS. 1 to 5 in particular, a first embodiment of the invention is shown. FIG. 1 shows a fitting 30 suitable for connecting a gas control valve 32 to a substantially vertical wall (see FIG. 3) of a water storage tank of a gas water heater. The fitting includes a slotted part 33 attached to the control valve 32 and has a substantially vertically extending slot 34, open at one, lower end portion 36 and merging with a wider opening 38, at its upper end portion 39, to admit a mating locator 40 attachable by a screw thread 42 to a socket welded to the substantially vertical wall of the tank, described subsequently in connection with FIG. 3. The valve 32 is of the well-known type that regulates the temperature of hot water in the tank. For use with this invention, it has a flexible capillary tube 44 connecting between a temperature sensor bulb 46 and a mechanism in the valve 32 to open or close gas flow, to a main burner that is described below. The valve 32 also has an energy cut-out 48 connected by flexible wire 50 to a circuit in the valve 32 to prevent overheating if the valve 32 fails in an open condition. A suitable valve commercially available is the 630 EUROSIT SERIE sw model from SIT Group of Italy (www.sitgroup.it). The valve as commercially available is not capable of being adjusted vertically or horizontally after connection to its mating locator 40. The mating locator as available is integrally joined to a hollow metal pocket 51 for insertion into the interior of the water heater tank.

FIG. 2 shows how the fitting components 33, 40 are initially connected, noting that the water storage tank and a rigid gas pipe connecting the valve 32 and burner are omitted in this illustration for the sake of clarity. The mating locator 40 and slotted part 33 are brought together in the relative position as indicated by the phantom dotted outline 52. The unbroken outline view of the pocket 51 with the mating locator 40 is in a typical relative position at the time of final assembly. The length of the slot 34 is about 2 inches (50 mm) to facilitate engagement and assembly of a combustion chamber or burner sub-assembly, illustrated and described later.

Figure 4:
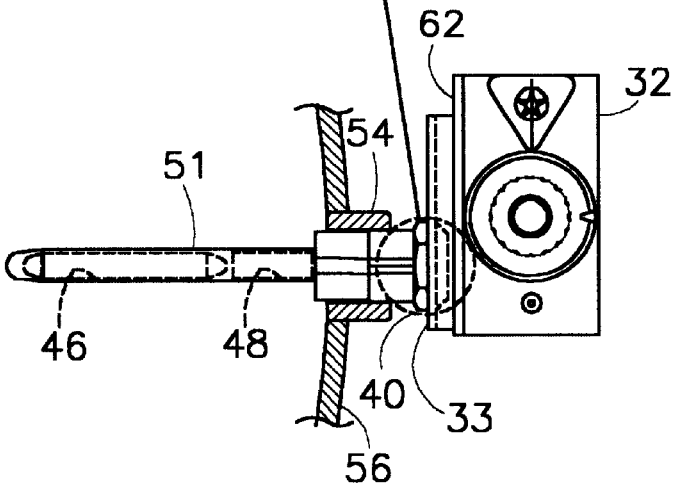
FIG. 4 is a plan view of the mount, valve and part of the tank of FIG. 3.

FIGS. 3 and 4 show the valve 32 in position with the mating locator 40 screwed into a socket 54 welded to the substantially vertical wall 56 of the water tank. Both the sensor bulb 46 and the energy cut-out 48 fit inside the hollow pocket 51. The pocket 51 extends substantially horizontally inwardly into the tank and neatly accommodates diametrically the temperature sensor 46 and is also long enough to accommodate the sensor 46 plus the energy cut-out 48. A portion of a rigid gas pipe 58 for connection to the main burner (not shown) is shown connected to an outlet port in a lower wall 60 of the valve 32. Not shown in FIG. 3 (for clarity) is a conventional layer of insulation and a protective jacket between the tank wall 56 and the wall 62 of the valve 32 closest to the tank wall 56 (hereinafter, the back wall 62 of the valve).

Figure 5:
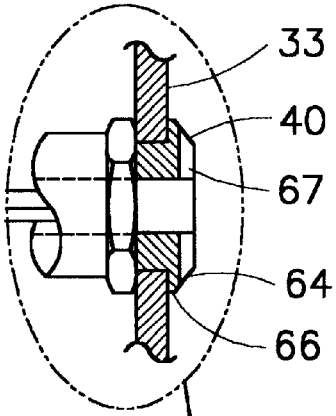
FIG. 5 is an exploded detail referenced from FIG. 4.

FIG. 5 shows a detail schematic part-section of the sliding fit connection between the slotted part 33 and the mating locator 40 comprising the fitting, when initially assembled, so connecting the valve 32 and tank together to allow relative substantially vertical movement whilst connected. The mating locator 40 has a tapered lead-in surface 64, not required in this embodiment but further described below. Inwardly (i.e., towards the tank wall 56) of the tapered lead-in 64 is a circumferential groove 66, the root diameter of which substantially matches the width of the lower end of the slot 34 so the parts connect together as a neat sliding fit. The tapered lead-in 64 has a transverse slot 67 along which can pass the capillary tube 44 and the wires 50 (see FIG. 1).

Figure 6:
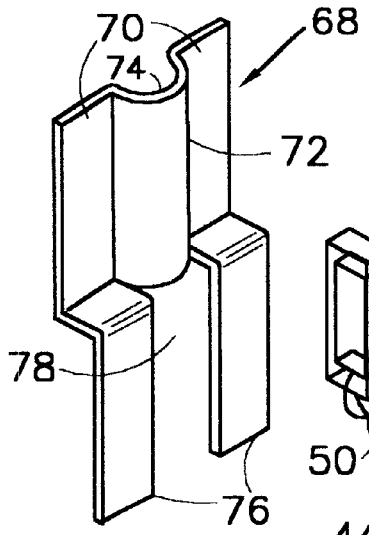
FIG. 6 shows a perspective view of another embodiment of a gas control valve adjustable mount according to the invention.
Figure 7:
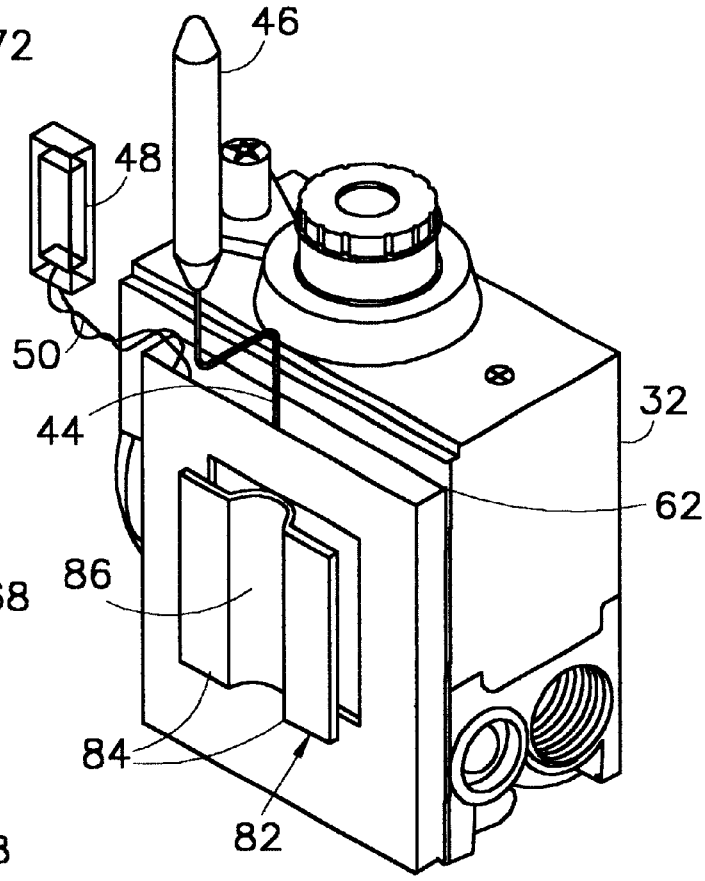
FIG. 7 shows a perspective view of the mount from FIG. 6 connected to a gas control valve.
Figure 8:
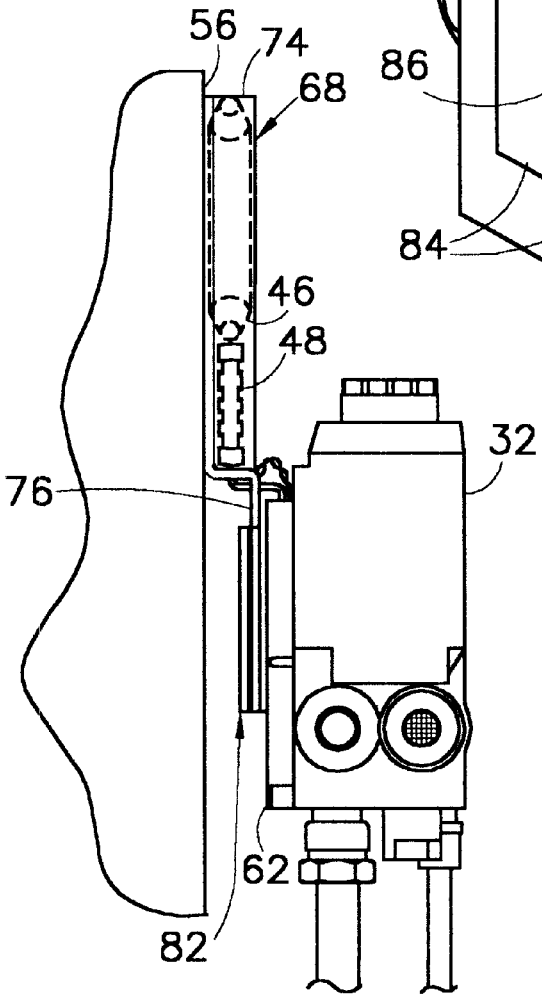
FIG. 8 shows an elevational view of the mount and gas control valve of FIG. 7 mounted to a wall of a tank of a water heater.

FIGS. 6 to 8 show an alternative embodiment of the fitting of the invention and corresponding parts common with the first embodiment are indicated by corresponding reference numerals.

FIG. 6 shows a mating locator 68 made of steel having (a) a pair of upper surfaces 70 shaped to contact the wall 56 of the tank; (b) a curved surface 72, the concave side of which defines a pocket 74 of size and shape to neatly accommodate the temperature sensor bulb 46 and energy cut-out 48 when the upper surfaces 70 are secured against the tank wall 56, the curved surface 72 joining the pair of upper surfaces; and, (c) a pair of arms 76, which extend first outwardly then downwardly (not drawn to scale) from each one of the pair of upper surfaces. The pair of arms 76 extend outwardly approximately the same distance as the desired thickness of insulation (including the protective jacket) surrounding the tank (typically about 2 inches) and downwardly about 2 inches (50 mm) to form a slot 78 between them.

FIG. 7 shows the valve 32 on the back surface of which is attached a fitting in the form of a bracket 82 to engage the mating locator 68. The bracket has two lateral flanges 84, which extend to left and right of a central channel 86 integrally attached to the back wall 62 of the valve 32. The distance between the lateral flanges 84 and the back wall 62 of the valve 32 is slightly less than the thickness of the arms 76 shown in FIG. 6. As with the embodiment of FIGS. 1 to 5, the sensor bulb 46 and energy-cut out 48 are flexibly attached to the valve 32 by, respectively, at least about several inches of a copper capillary tube 44 and a pair of insulated copper wires 50.

FIG. 8 shows the mating locator 68 of FIG. 6 welded to the wall 56 of a water heater tank together with the valve 32 and the bracket 82 of FIG. 7 attached (not to scale) to the locator 68. The sensor bulb 46 and energy-cut out 48 are schematically shown, inserted in the pocket 74 extending longitudinally in a substantially vertical direction against the outer surface of the tank wall 56. The lateral flanges 84 are sprung open by the insertion of the arms between them and the back wall 62 of the valve 32 so that the valve 32 is gripped firmly. However, valve 32 can be slid upwardly or downwardly into a final desired position. Not shown in FIG. 8 (for clarity) is a conventional layer of insulation and a protective jacket between the tank wall 56 and the back wall 62 of the valve 32. Available space in the pocket 74 between it and the sensor bulb 46 can advantageously be filled with a thermally conductive heat transfer paste.

Figure 9:
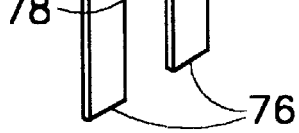
FIG. 9 shows a perspective view of still another embodiment of a gas control valve adjustable mount according to the invention.
Figure 10:
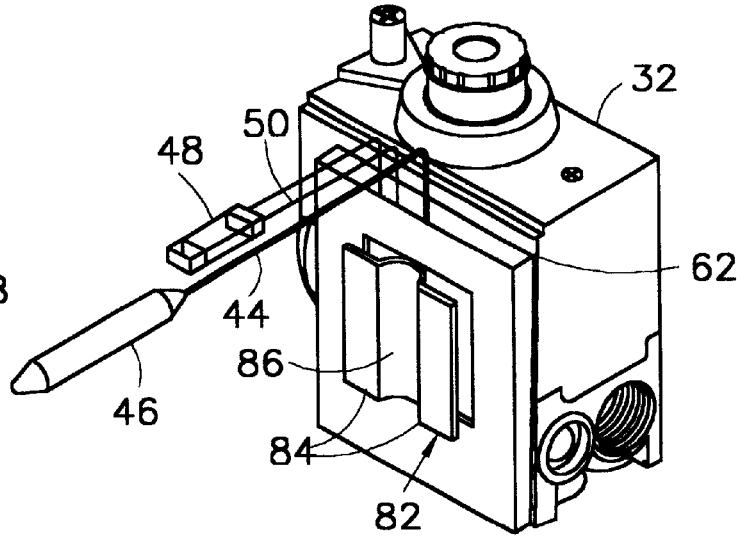
FIG. 10 shows a perspective view of the mount from FIG. 9 connected to a gas control valve.
Figure 11:
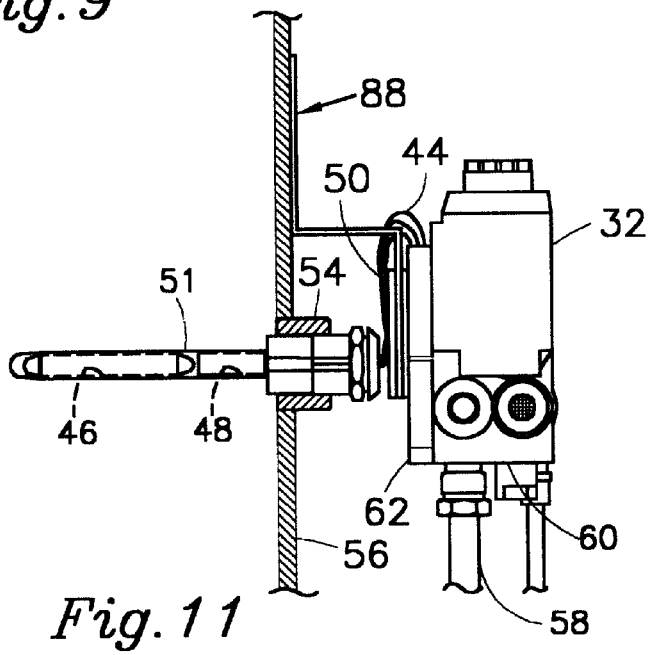
FIG. 11 shows an elevational view of the mount and gas control valve of FIG. 10 mounted to a wall of a tank of a water heater.

FIGS. 9 to 11 show another alternative embodiment of the fitting of the invention and corresponding parts common with the other embodiments are indicated by corresponding reference numerals.

FIG. 9 shows a mating locator 88 made of steel having (a) an upper surface 90 shaped to contact the wall 56 of the tank; and, (b) a pair of arms 76 which extend first outwardly then downwardly from the upper surface 90. The pair of arms 76 extend, outwardly, approximately the same distance as the desired thickness of insulation (and protective jacket) surrounding the tank (typically about 2 inches) and, downwardly, about 2 inches (50 mm) to form a slot 78 between them.

FIG. 10 shows a valve 32 to the back of which is attached a fitting in the form of a bracket 82 to engage the mating locator 88. The bracket has two lateral flanges 84, which extend to left and right of a central channel 86 integrally attached to the back wall 62 of the valve 32. The distance between the lateral flanges 84 and the back wall 62 of the valve 32 is slightly less than the thickness of the arms 76 shown in FIG. 9. As with the embodiments of FIGS. 1 to 5 and FIGS. 6 to 8, the temperature sensor bulb 46 and energy-cut out 48 are flexibly attached to the valve 32 by, respectively, at least about several inches of a copper capillary tube 44 and a pair of insulated copper wires 50.

FIG. 11 shows the valve 32 and the bracket of FIG. 10 attached to the locator 88. The sensor bulb 46 and energy-cut out 48 are schematically shown, inserted in the pocket 51 extending radially inwardly in a horizontal direction into the tank. The pocket 51 is screwed into the socket 54 welded to the wall 56 of the water tank at an opening provided. A portion of the rigid gas pipe 58 leading to the main burner is shown. Not shown in FIG. 11 (for clarity) is a conventional layer of insulation and a protective jacket between the tank wall 56 and the back wall 62 of the valve 32.

Figure 12:
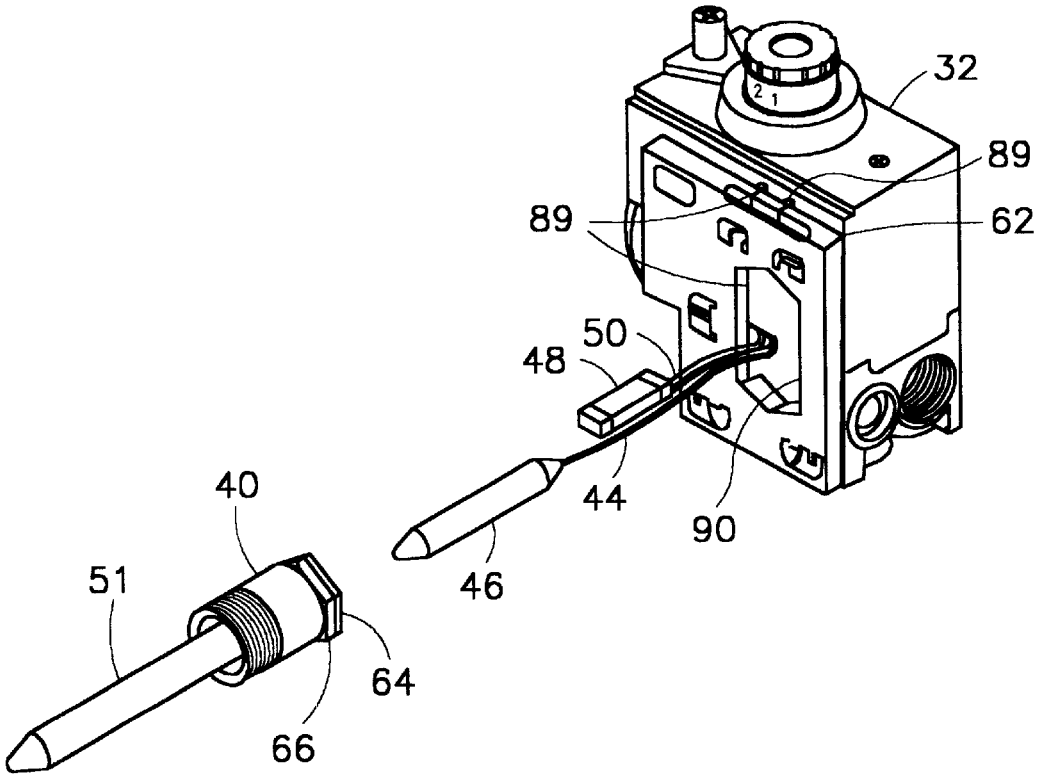
FIG. 12 shows a perspective view of yet another embodiment of a gas control valve adjustable mount according to the invention.
Figure 13:
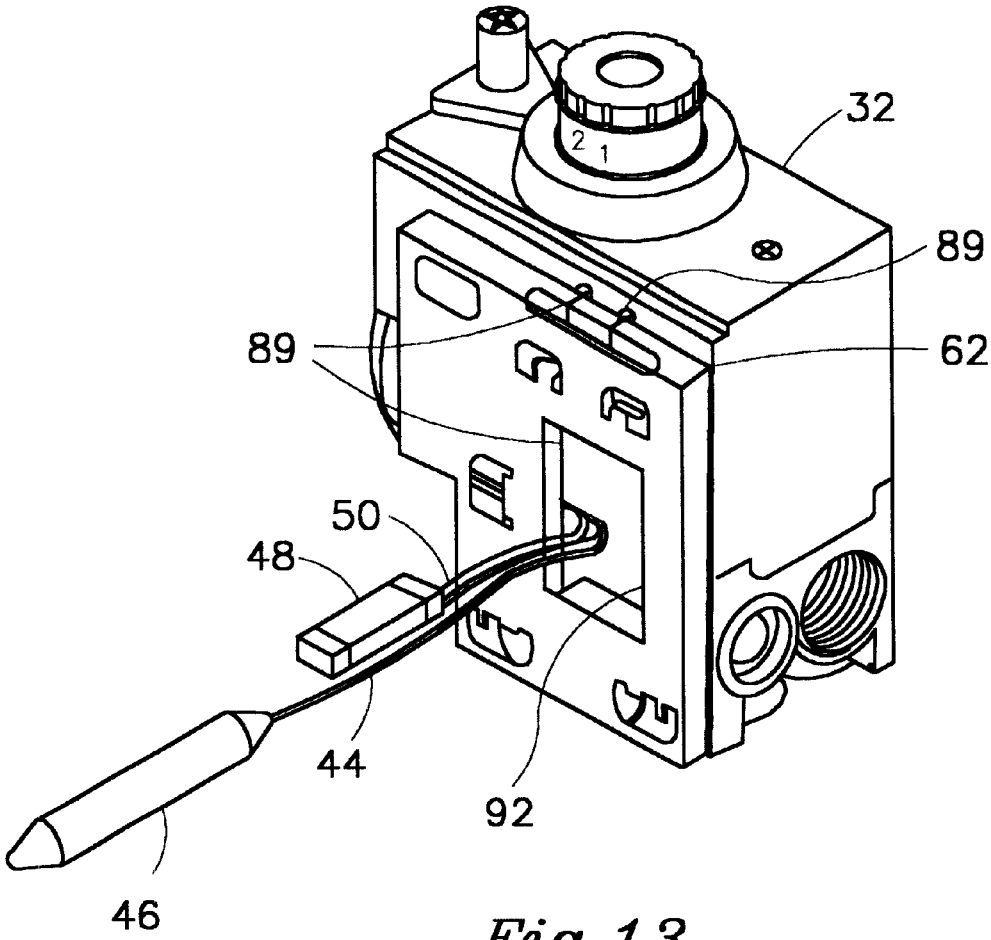
FIG. 13 shows a perspective view of a further embodiment of a gas control valve adjustable mount according to the invention.

FIGS. 12 and 13 show two further embodiments of the invention.

FIG. 12 shows a valve 32 in which a back, substantially vertical wall 62 is modified from the commercially available valve 32 in that the normally provided regular, equi-sided, hexagon shaped opening in the back wall 62 of the valve 32 as purchased is replaced by an irregular, elongated hexagon shaped opening 90. The elongation of the hexagon 90 is aligned with its longest axis of symmetry substantially vertical when the valve 32 is upright, as illustrated. The mating locator 40 has a tapered lead-in surface 64 as was illustrated in FIG. 5, to enable the fitting and mating locator 40 to snap fit together with a single substantially horizontal movement while in or close to the desired substantially vertical position. This enables manufacturing tolerances in the vertical direction to be accommodated, which, typically may amount to about $1/8^{th}$ inch (3 mm) but may, in some cases, be about $5/16^{th}$ inch (8 mm). The commercially available 630 Eurosit serie sw valve is provided with spring wires 89 which extend substantially vertically up either side of the regular hexagonal opening and which are sprung apart by the entry motion of the tapered lead-in 64 and which snap closed when the circumferential groove 66 (FIG. 5) moves into alignment with the spring wires 89. Because of the elongation of the hexagon in the invention, substantially vertical movement is possible because the groove 66 and wires 89 can slide relative to each other. The relative vertical movement desired for the embodiment is in the range of about $1/8^{th}$ inch (3 mm) to about $1/8^{th}$ inches (8 mm) to accommodate likely manufacturing tolerances in the vertical direction on assembly.

FIG. 13 shows an embodiment conceptually the same as that shown in FIG. 12. The difference is that the elongated hexagon 90 of FIG. 12 is instead a rectangle 92 having its longer sides extending substantially vertically.

Figure 16:
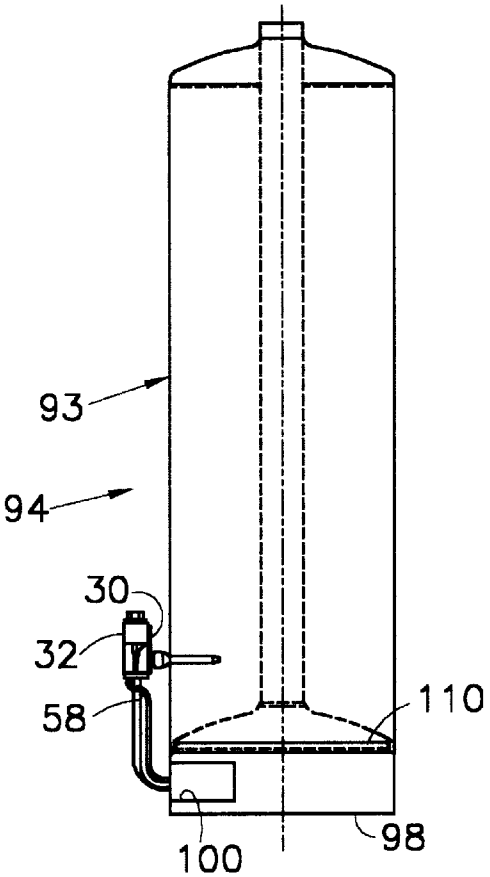
FIGS. 14 to 16 show elevational views of three successive steps in assembly line processes for water heaters, using the adjustable mount of FIGS. 1 to 5, according to the invention.
Figure 15:
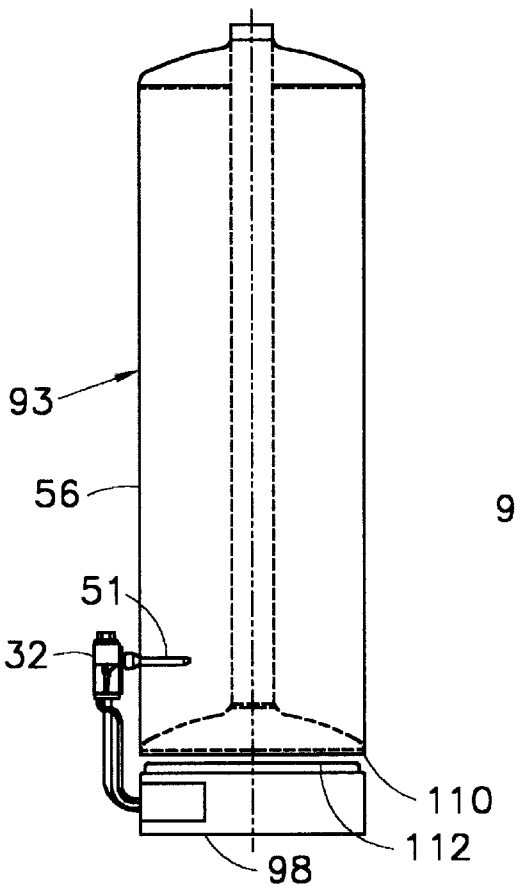
Figure 14:
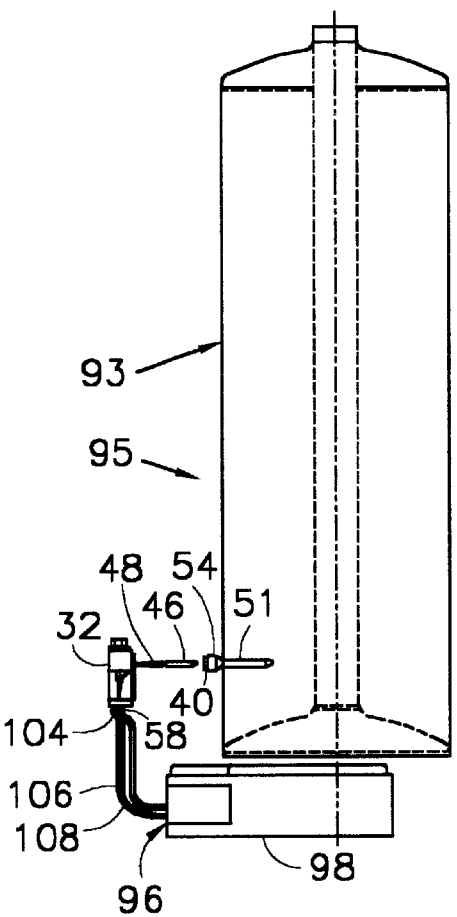

FIGS. 14 to 16 show a first method according to the invention, of assembling a sub-assembly of a gas control valve 32, a burner and combustion chamber to a water heater tank 93 to produce a water heater tank assembly 94, according to a further aspect of the invention, ready to be subsequently insulated further along a main assembly line.

FIG. 14 shows the steps of bringing together two sub-assemblies on a water heater production line. The first sub-assembly 95 is a water heater tank 93 including an internally threaded socket 54 welded around a hole in the tank wall, through which a mating locator 40 including a pocket 51 is leak-tightly screwed. The pocket 51 has an inside diameter and length sized to accept entry of the temperature sensor bulb 46. The second sub-assembly 96 includes a combustion chamber 98 of the sealed type, joined to a manifold plate 100, through which passes two tubes 58 and 104 and two shielded wires 106 and 108, respectively connecting, inside the combustion chamber, a conventional main burner, a pilot burner, a thermocouple and a pilot light igniter to the gas control valve 32. The gas control valve 32 is connected to the main burner by a rigid gas pipe 58, preferably made of ½ inch diameter steel tube, with an approximately right angled bend, so that, when assembling the two sub-assemblies 94 and 96 there is very limited scope for altering the relative positions of the gas valve 32 and combustion chamber. The choice of a soft annealed grade of copper for the gas pipe 58 is not available in many places since the commonplace natural gas fuel used contains sulfur compounds which corrode copper over time. The pilot burner gas pipe 104 and wires 106 and 108 are relatively flexible. The slotted part 33 of the fitting 30 for mounting the gas control valve 32 to the water heater tank 93 has been previously provided on the back wall 62 of the valve 32 and a mating locator 40 provided at the end of the pocket 51 protruding from the water heater tank 93, as shown in FIG. 1.

FIG. 15 shows the next step in sequence in which the sensor bulb 46 and energy cut-out 48 are inserted into the pocket 51, both being supplied flexibly connected to the gas control valve 32. Next, the combustion chamber 98 having a top edge 112 is aligned with and slightly spaced away from the concave base 110 of the water heater tank 93. Then the control valve 32 including the slotted part 33 of the adjustable mounting fitting attached to it is brought close to the wall 56 of the water heater where, as shown in FIG. 2, the mating locator 40 is protruding and the wider opening 38 at the top of the slot 34 is moved over the mating locator 40 to align the circumferential groove 66 (FIG. 5) in it with the elongated opening.

FIG. 16 shows a subsequent step, in which the sub-assembly 96 from FIG. 14 including the combustion chamber 98 plus gas valve 32 and the sub-assembly 95 including the water heater tank 93 are brought together to simultaneously insert the reduced diameter top edge 112 of the combustion chamber 98 into the concave base 110 of the tank 93 and to slide it fully inwards as far as it can travel into the base. At the same time, the control valve 32, including the part 33 of the adjustable mount attached to it, is slid into the narrower part of the elongated opening to attach it to the mating locator 40, as also shown in FIG. 2. As the combustion chamber 98 is moved to its sealed position, the two parts 33 and 40 of the fitting 30 slide relative to each other as may be required to reposition the gas control valve 32 at whatever precise distance is dictated by the dimension between the rigid pipe 58 emerging from the manifold plate 100 and the outlet port of the gas valve 32 with the main gas pipe 58 leak-tightly attached to it by a flared or like fitting. The precise distance from the end of the assembly will vary according to normal variation experienced in high volume production of water heaters, which in practice may be in a range of ± about $1/8^{th}$ to about $5/16^{th}$ of an inch. (about 3 to about 8 mm). The valve 32 is locked firmly into its assembled position by the rigid tube 58 being firmly fixed to the manifold plate 100 and to the gas valve 32. The assembly as shown in FIG. 16 is completed conventionally by enclosing it in a metal jacket and surrounding the tank 93 with a heat insulation combination of pre-formed and foam-in-place types. The jacket may be modified to take account of one unconventional aspect of this method in that the gas valve 32 is attached before rather than after applying the insulation.

FIGS. 17 to 20 show another embodiment of the method aspect of the invention, which is applicable to the embodiments of valve 32 shown in FIGS. 12 and 13, which engage with the mating locator 40 inserted in the tank 93 by a horizontal movement and a snap action. It is equally applicable to sealed or unsealed combustion chamber types of water heater.

Figure 17:
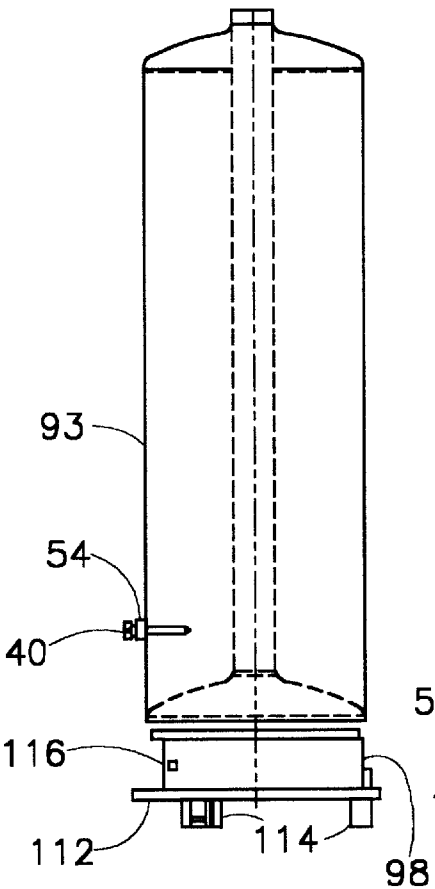

FIG. 17 shows the step of the tank 93 with socket 54 and mating locator 40 being aligned with a combustion chamber 98 plus base pan 112 and 114 legs immediately prior to being assembled to one another by axial movement relative to one another. The combustion chamber has an entry hole 116.

Figure 18:
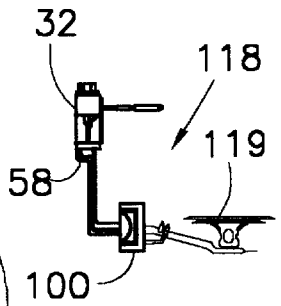

FIG. 18 shows the provision of a second sub-assembly 118 used in this method, of a manifold plate 100, through which passes two tubes and two shielded wires respectively connecting a main burner 119, a pilot burner, a thermocouple and a pilot light igniter to the gas control valve 32. The gas control valve 32 is, again, connected to the main burner 119 by the rigid gas pipe 58, preferably made of ½ inch diameter steel tube, with an approximately right angled bend, so that, when assembling the two sub-assemblies there is very limited scope for altering the relative positions of the gas valve 32 and manifold plate 100. The manifold plate 100 can be faced with heat-resistant compressible gasket material (not illustrated) to seal the entry hole 116 of the combustion chamber 98 in a leak-tight manner if required.

Figure 19:
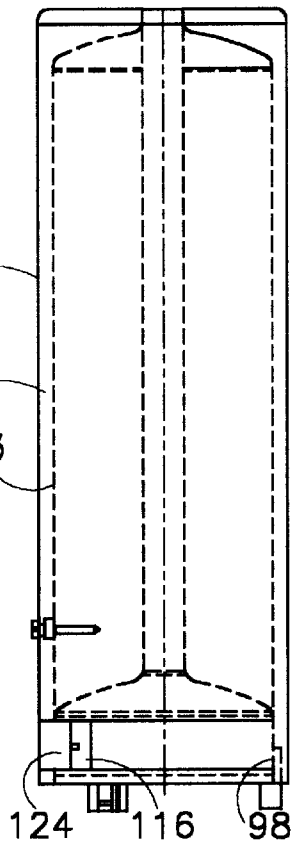

FIG. 19 shows the provision of a steel jacket 120 and an insulation layer 122 between the tank 93 and the jacket, creating an entry hole 124 in the jacket 120 and the entry hole 116 in the combustion chamber 98.

Figure 20:
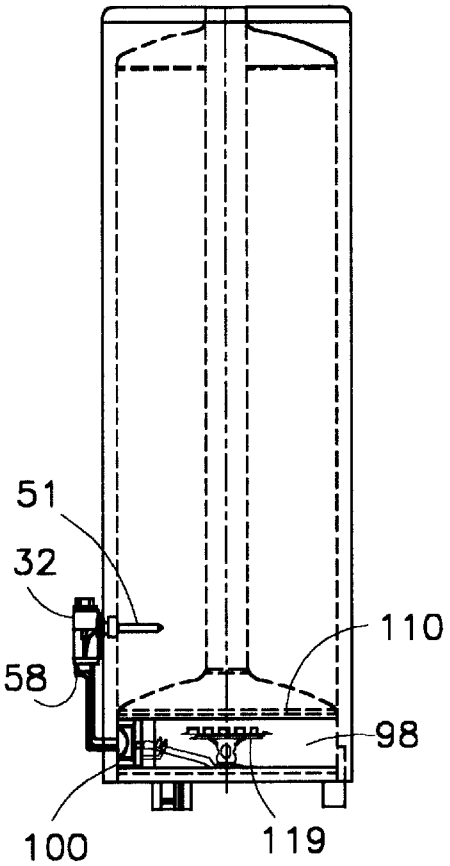
FIGS. 17 to 20 show elevational views of three successive steps in assembly line processes for water heaters, using the adjustable mount of FIGS. 1 to 5, according to another aspect of the invention.

FIG. 20 shows the step of inserting the sub-assembly 118 into the insulated and jacketed tank 93 and combustion chamber, while simultaneously inserting the sensor bulb 46 and energy cut-out 48 into the pocket 51 and attaching the gas valve 32 to the mating locator 40 at the protruding end of the pocket 51. As is clear from inspection of FIGS. 18 to 20, the assembly step involves essentially substantially horizontal movement of the sub-assembly 118 shown in FIG. 18 toward the sub-assembly shown in FIG. 19. The provision of either an elongated hexagonal or rectangular opening in the mounting bracket as shown in FIGS. 12 and 13 (or directly in the back wall 62 of the valve 32) enable it to attach regardless of assembly tolerances. If the combustion chamber 98 is the sealed type, the manifold plate 100 aligns with the opening 116 in the combustion chamber 98 and fastener holes in each part. Variability in the distance between the fastener holes and position in the tank wall 56 of the pocket 51 and in the distance between the entry of the rigid pipe 58 into the manifold plate 100 and gas valve 32 determines the final position of the gas valve 32 in the completed assembly. If the burner 119 is not to be inserted into a sealed combustion chamber but merely centralized under the tank 93 in a relatively open combustion space, then additional tolerance is available in the assembled position of the main burner 119 relative to the lower wall 110 of the tank 93. However, the adjustability of the gas valve 32 mount is still beneficial in that it enables the option of insulating the tank 93 before attaching the second (valve 32 plus manifold plate 100 plus burner 119) sub-assembly as was described in relation to FIG. 16. It enables the main burner 119 to locate precisely in its optimum position in the combustion space and also realizes a productivity benefit of making the subassembly of FIG. 18 away from a main assembly line for water heaters.

Not illustrated in FIG. 20 or elsewhere is the further option of including a locking device contestable to one or other of the fitting 30 or the valve 32 and the external surface of the jacket 120, to augment the rigidity of the positioning provided by the gas pipe 58 connecting the valve 32 to the burner 119 and its other attachment to the manifold plate 100 and hence the rigidly attached combustion chamber 98. The locking device may include a right-angled tab.

Figure 21:
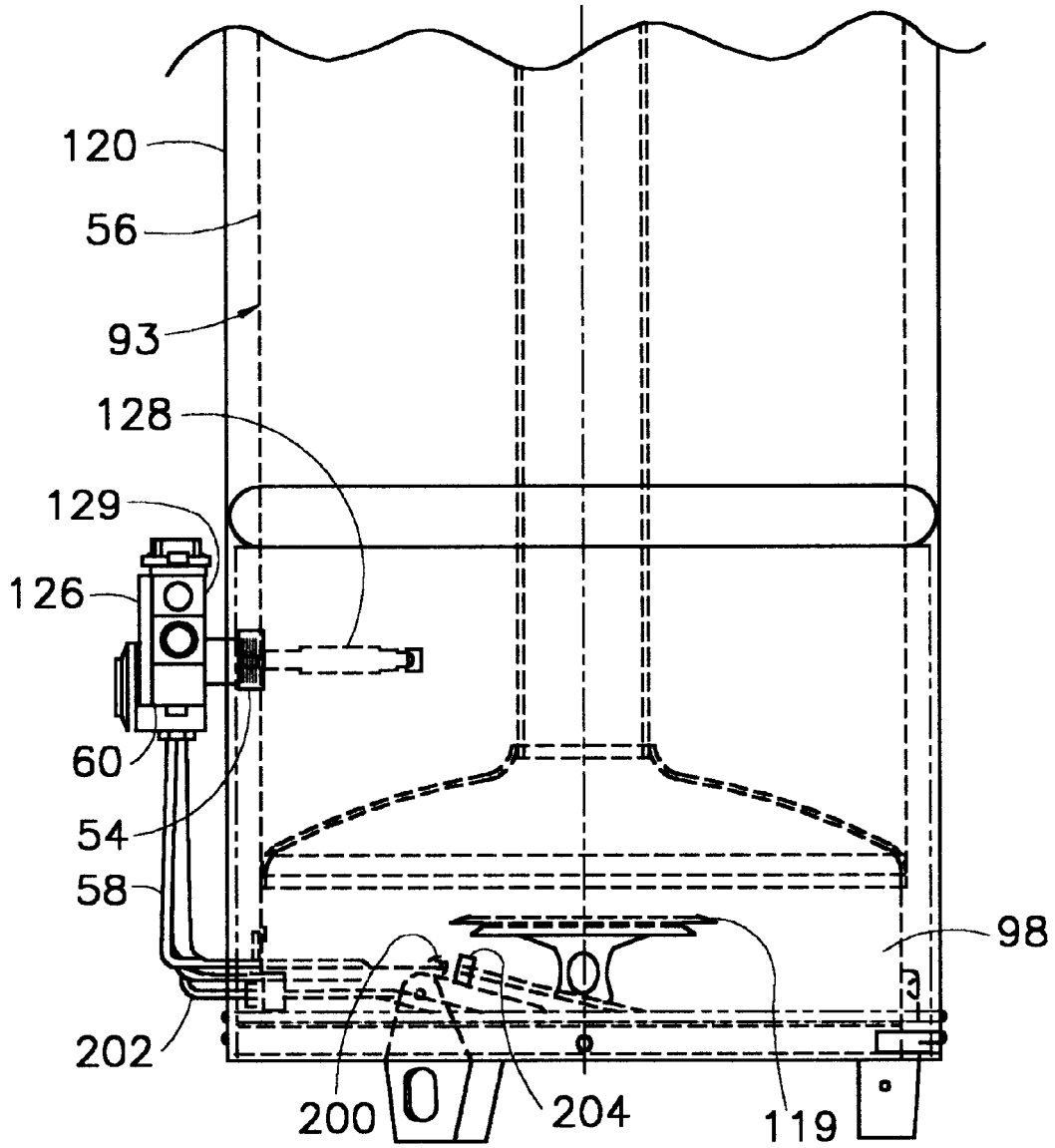
Fig. 21 PRIOR ART
FIGS. 21 to 24 show close prior art water heaters with sealed combustion chambers.

FIGS. 21 to 24 show water heater parts and sub-assemblies, to assist understanding of the present invention. FIG. 21 is a cross-section through the lower end of a sealed combustion chamber type water heater having a tank 93, a sealed combustion chamber 98, a main burner 119, a pilot burner 200, a main gas pipe 58, a pilot gas pipe 202, a piezo igniter 204 and a thermocouple. The main gas pipe 58 is substantially rigid and is substantially rigidly connected to a gas control valve 126 at one end and the other to the burner 119. The gas control valve 126 is a traditionally used type, which has a temperature sensor 128 rigidly connected and protruding at a right angle from the back wall 129 of the valve. The valve 126 is attached to the tank 93, sealing it at the same time, by screwing it into a socket 54 welded to surround a hole in the wall 56 of the tank 93.

Figure 22:
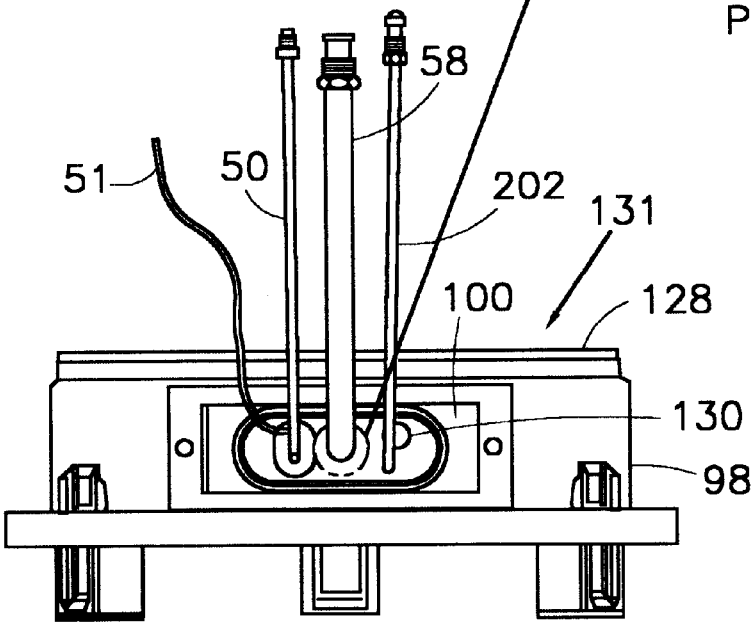
Fig. 22 PRIOR ART

FIG. 22 is a combustion chamber sub-assembly 131 made separately away from the main water heater assembly line. The combustion chamber 98 is open across its top end 128 and has a flame trap (not visible) in the lower wall. When engaged with the water heater tank 93 on the main assembly line as shown in FIG. 21 it becomes a "sealed" combustion chamber. Prior to that step and away from the main assembly line it is tested for certain leakage points as will be described, using a stroboscopic light. The combustion chamber sub-assembly 131 has an opening in the vertical wall, which is closed by a manifold plate 100 having openings through which pass the main gas pipe 58, the pilot gas pipe 202 and wires 50 and 51 for a Piero igniter and a thermocouple. A further opening is formed, which is closed by a transparent observation window 130.

Figure 23:
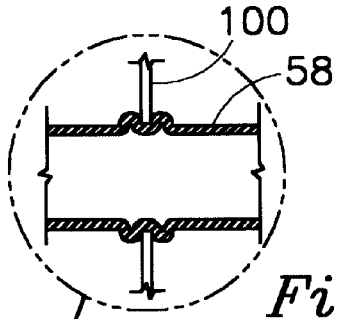
Fig. 23 PRIOR ART

FIG. 23 shows the rigid gas pipe 58 passing through the manifold plate 100, being upset on either side of the plate 100 to seal the opening and connection to at least an effective flame trapping standard. The mechanical joint of the plate and pipe 58 is also rigid. The interconnection between the manifold plate 100 and its opening, along with all the points where connections pass through the manifold plate 100 are tested by the stroboscopic light procedure.

Referring to both FIGS. 21 and 22, the procedure to assemble the water heater is:

(a) make the tank 93 and screw the gas control valve 126 into the socket 54 attached to the tank wall 56;

(b) make the combustion chamber sub-assembly 131 as shown in FIG. 22 and leak test it;

(c) assemble the combustion chamber 98 to the tank 93;

(d) connect the rigid gas pipe 58, the pilot gas pipe 202, the thermocouple wires 50 and the Piero igniter wires 51 to their respective connecting points in the lower wall 60 of the valve; and, e) apply a jacket 120 and insulate the tank 93.

In step (d), the rigidity of the main gas pipe 58 can cause it to be difficult to assemble to the valve if the accumulated dimensional tolerances of the preceding manufacturing steps exceed the limits for ensuring a high quality gas-tight attachment of the main pipe 58 at the valve. Because of this difficulty, one prior solution has been adopted, illustrated in FIG. 24.

Figure 24:
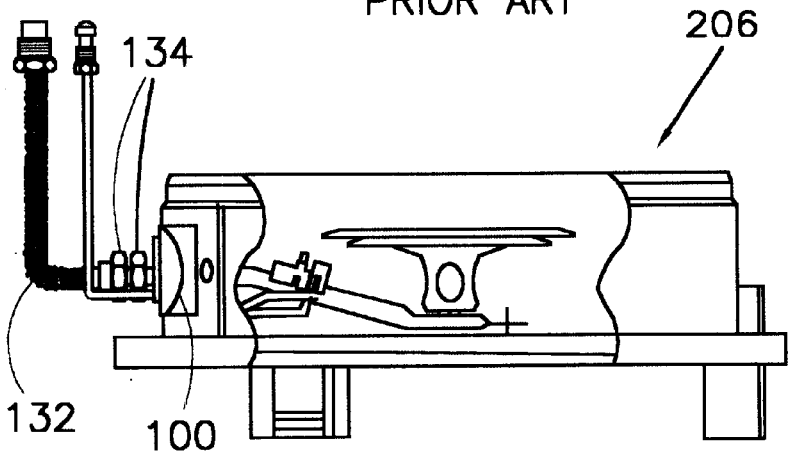
Fig. 24 PRIOR ART

FIG. 24 shows a combustion chamber sub-assembly 206, which is, in all respects except one, the same as that shown in FIG. 22. The difference is that in the FIG. 24 version, the gas connection from the main burner, external to and extending outwardly from the combustion chamber is changed to a gas tight flexible metal hose 132, connected to the gas pipe 208 by a pair of coupling nuts 134. The gas pipe 208 is swaged rigidly to the manifold plate 100 in the same way as pipe 58 was shown in FIG. 23. However, the flexible hose 132 enables compensation for variable distances between the assembled position of the combustion chamber relative to the gas control valve. Because of proximity to the heat of the combustion chamber and other factors, a high integrity metal flexible hose is required. Although, therefore, it is one solution to the dimensional tolerance build-up problem, it is an expensive one. The present invention replaces that expensive solution by a lower cost alternative and also provides options in assembly steps, which can further reduce costs of high volume production of water heaters having additional consumer benefits.

What is claimed is:

1. A fitting for connecting a gas control valve to a water storage tank of a gas water heater comprising a base member having an elongated opening sized and shaped to receive a mating locator attached to said tank, which permits connection of said valve and tank together and allows relative movement whilst the connection is maintained.

2. The fitting as claimed in claim 1, wherein said base member is a bracket attached to said valve in which is formed said elongated opening.

3. The fitting as claimed in claim 1, in which said elongated opening is included in a substantially vertically oriented wall of said valve.

4. The fitting as claimed in claim 1 in which said mating locator is adapted to enclose a temperature sensor flexibly connected to said valve.

5. The fitting as claimed in claim 1 in which said elongated opening is an irregular hexagon having a longitudinal axis of symmetry extending substantially vertically.

6. The fitting as claimed in claim 1 in which said elongated opening is a rectangle having longer sides extending substantially vertically.

7. The fitting as claimed in claim 2 in which said mating locator is integral with a pocket extending substantially horizontally inwardly into said tank, said pocket adapted to enclose a temperature sensor.

8. The fitting as claimed in claim 2 in which said mating locator is integral with a pocket extending longitudinally along an exterior surface of said tank wall.

9. The fitting as claimed in claim 1 in which said relative movement is in the range of at least about 3 mm to about 50 mm.

10. The fitting as claimed in claim 1 further comprising a lock connectable to one of said fitting and said valve, to prevent relative vertical movement of said valve when said lock is connected to said fitting and/or said valve and to a part of said water heater.

11. The fitting as claimed in claim 10, in which said lock is a substantially rigid pipe connecting an outlet port of said valve with a burner enclosed in a predetermined position in a sealed combustion chamber of said tank of said water heater.

12. The fitting as claimed in claim 10, in which said lock is a substantially right-angled tab joining said bracket to an adjacent surface of a jacket of said water heater.

13. A method of producing a water heater comprising:

a) providing a water heater tank with a pocket, sized and shaped to receive a temperature sensor;

b) providing an adjustable mount for mounting a gas control valve to said water heater tank;

c) positioning said temperature sensor into said pocket;

d) positioning a combustion chamber adjacent to a base portion of said water heater tank;

e) mounting said control valve to said water heater tank via said adjustable mount; and f) causing relative movement between said combustion chamber and said water heater tank and said control valve relative to said adjustable mount to reposition said gas control valve on said mount and have said combustion chamber engage said tank.

14. The method as claimed in claim 13 in which a portion of said adjustable mount is attached to said gas control valve to allow said gas control valve to connect to a mating adaptor portion of said pocket and be adjustable thereon.

15. The method as claimed in claim 14 in which said adjustable mount is formed from an elongated aperture on said control valve, said aperture receiving said mating adaptor.

16. The method as claimed in claim 15 in which said aperture has associated with it a latch to receive and hold said mating adaptor while allowing height adjustable movement of said control valve relative to said pocket.

17. A method of assembling a water heater comprising:

a) providing in a water heater tank a pocket sized and shaped to receive a temperature sensor;

b) providing a mating adaptor on an outwardly protruding end portion of said pocket;

c) forming a first sub-assembly including a gas control valve and a gas burner, said gas control valve being connected to said burner via at least one substantially rigid conduit;

d) providing said first sub-assembly with a manifold plate, through which passes a plurality of tubes and shielded wires respectively connecting the burner, a pilot burner, an energy sensor and a pilot light igniter to the gas control valve;

e) providing an adjustable mount for mounting said gas control valve to said water heater tank;

f) substantially aligning a base portion of said tank with a combustion chamber preassembly having a base pan and an entry hole;

g) assembling said combustion chamber pre-assembly to said tank by axial movement and circumferentially aligning said entry hole with said mating adaptor;

h) providing a jacket and an insulation layer between the tank and the jacket, while substantially aligning an entry hole in said jacket and said entry hole in said combustion chamber; and i) inserting said first sub-assembly into the insulated and jacketed tank and combustion chamber, while substantially simultaneously inserting the temperature sensor and the energy sensor into the pocket and attaching the gas valve to the mating adaptor.

18. The method as claimed in claim 17 further comprising sealing the combustion chamber by aligning and attaching said manifold plate to said opening in the combustion chamber by joining with mating fastener holes.

19. The method as claimed in claim 18 further comprising providing an additional fastener connection between the valve and an external wall of the jacket, connected following said step (h).

20. A gas-fueled water heater comprising:

a storage tank;

water inlet and outlet connections to said tank;

a combustion chamber connected to one end portion of said tank;

a main burner and pilot burner adapted to be located in pre-determined positions in said combustion chamber;

a gas supply line connected to said burner;

a gas control valve having an inlet port to receive a supply of fuel gas from the gas supply line;

a pipe adapted to connect an outlet port of said valve to said main burner, said pipe having a bend between its opposite end portions;

a temperature sensor connected to said gas control valve by a substantially flexible tube, said sensor being adapted to co-operate with the gas valve to control water temperature in said tank at a location of a pocket adapted to house said temperature sensor, said pocket being attached to a wall of said tank;

an insulation layer surrounding said tank;

a protective jacket surrounding said insulation layer; and a mounting adapted to connect the gas control valve to said water heater in an adjustable position relative to said pocket; said mounting including an elongated slot to receive a mating locator with said gas control valve, to releasably connect said valve and mounting together and allow relative movement whilst remaining connected.

21. The gas-fueled water heater as claimed in claim 20, further comprising a fastener rigidly locking together said valve and said jacket.

22. The gas-fueled water heater as claimed in claim 20, further comprising an internally threaded socket pressure-tightly welded to the wall of the tank to form a threaded opening wherein said pocket is screwed into said socket and projects radially inwardly into said tank and seals the tank against water leakage.

* * * * *

UNITED STATES PATENT AND TRADEMARK OFFICE

CERTIFICATE OF CORRECTION

PATENT NO. : 6,371,057 B1
DATED : April 16, 2002
INVENTOR(S) : Henderson

It is certified that error appears in the above-identified patent and that said Letters Patent is hereby corrected as shown below:

Title page,
Item [73], please change "SRP 68/Pty, Ltd. (AU)" to -- SRP 687/Pty, Ltd. (AU) --.

Signed and Sealed this

Eighth Day of October, 2002

*Attest:*

*Attesting Officer*

JAMES E. ROGAN
*Director of the United States Patent and Trademark Office*